US006814245B2

(12) United States Patent
Leclerc et al.

(10) Patent No.: US 6,814,245 B2
(45) Date of Patent: Nov. 9, 2004

(54) HYBRID SHELVING UNIT

(75) Inventors: Simon Leclerc, Montmagny (CA); Serge Rainville, Charlesbourg (CA)

(73) Assignee: Montel Inc., Montmagny (CA)

( * ) Notice: Subject to any disclaimer, the term of this patent is extended or adjusted under 35 U.S.C. 154(b) by 84 days.

(21) Appl. No.: 10/265,985

(22) Filed: Oct. 9, 2002

(65) Prior Publication Data

US 2004/0069733 A1 Apr. 15, 2004

(51) Int. Cl.[7] ..... A47F 5/00

(52) U.S. Cl. ..... 211/187; 211/135; 108/107; 108/109

(58) Field of Search ..... 211/187, 186, 211/135; 108/107, 109

(56) References Cited

U.S. PATENT DOCUMENTS

| | | | | | |
|---|---|---|---|---|---|
| 2,631,913 | A | * | 3/1953 | Rosenberg | 312/265.2 |
| RE24,535 | E | * | 9/1958 | Franks | 211/191 |
| 2,918,176 | A | * | 12/1959 | Francis et al. | 211/191 |
| 2,933,196 | A | | 4/1960 | Childs | |
| 3,199,471 | A | * | 8/1965 | Orsi | 108/187 |
| 3,266,635 | A | * | 8/1966 | McConnell | 211/191 |
| 3,608,504 | A | * | 9/1971 | Peters | 108/109 |
| 4,379,430 | A | * | 4/1983 | Ruschitzka | 108/107 |
| 4,453,641 | A | | 6/1984 | Rasmussen et al. | |
| 4,708,252 | A | | 11/1987 | Azzi | |
| 5,131,781 | A | | 7/1992 | Klein | |
| 5,279,430 | A | | 1/1994 | Benton | |
| 5,622,415 | A | * | 4/1997 | Felsenthal et al. | 312/265.4 |
| 5,749,481 | A | * | 5/1998 | Miller | 211/191 |
| 5,752,610 | A | * | 5/1998 | Remmers | 211/181.1 |
| 6,223,916 | B1 | | 5/2001 | Enos | |
| 6,659,294 | B1 | * | 12/2003 | Simard | 211/181.1 |
| 2004/0050814 | A1 | * | 3/2004 | Roush et al. | 211/201 |

* cited by examiner

*Primary Examiner*—Robert W. Gibson, Jr.
(74) *Attorney, Agent, or Firm*—Francois Martineau

(57) ABSTRACT

The hybrid shelving unit comprises first and second spaced-apart end frame portions, an intermediate frame portion located spacedly between the first and second end frame portions, a first spacer element attached to the first end frame portion and linking the first end frame portion and the intermediate frame portion, a second spacer element different from the first spacer element, attached to the second end frame portion and linking the second end frame portion and the intermediate frame portion, first brackets attaching the first spacer element to the intermediate frame portion, second brackets different from the first brackets and attaching the second spacer element to the intermediate frame portion, first shelves located and supported between the first end frame portion and the intermediate frame portion, and second shelves located and supported between the second end frame portion and the intermediate frame portion.

15 Claims, 7 Drawing Sheets

HYBRID SHELVING UNIT

FIELD OF THE INVENTION

The present invention relates to shelving units, and more particularly to a hybrid shelving unit.

BACKGROUND OF THE INVENTION

Known shelving units include a ground-resting frame comprising a number of upright posts which are linked to one another by means of crossbars. The upright posts are provided with slots spaced apart therealong. The crossbars releasably engage these slots to link the posts with fingers provided on the crossbars. Shelves in the form of platforms are provided between the posts, with the shelves either engaging the slots of the posts directly by means of fingers provided on the shelves, or with the shelves resting on crossbars with the latter having fingers engaging the slots of the posts. The problem with such conventional shelving units is that a single attachment means in the form of the co-operating fingers and slots, are provided on the shelving units, thus providing limited versatility to the shelving units.

SUMMARY OF THE INVENTION

The present invention relates to a hybrid shelving unit comprising:

first and second spaced-apart end frame portions;

an intermediate frame portion located spacedly between said first and second end frame portions;

a first spacer element attached to said first end frame portion and linking said first end frame portion and said intermediate frame portion;

a second spacer element different from said first spacer element, attached to said second end frame portion and linking said second end frame portion and said intermediate frame portion;

first attachment means, attaching said first spacer element to said intermediate frame portion;

second attachment means different from said first attachment means and attaching said second spacer element to said intermediate frame portion; and first shelves located and supported between said first end frame portion and said intermediate frame portion, and second shelves located and supported between said second end frame portion and said intermediate frame portion.

In one embodiment, said first attachment means comprises a first set of slots provided on said intermediate frame portion and at least one first bracket co-operating with and engaging said first set of slots, each one of said at least one first bracket being attached to said first spacer element.

In one embodiment, said second attachment means comprises a second set of slots provided on said intermediate frame portion and at least one second bracket co-operating with and engaging said second set of slots, said at least one second bracket being attached to said second spacer element.

In one embodiment, said first spacer element is a hinged brace comprising a pair of rods hinged at an intermediate portion thereof, each rod of said pair of rods having a first extremity attached to said first end frame portion and a second extremity equipped with a said first bracket.

In one embodiment, said intermediate frame portion comprises four parallel posts integrally linked by pairs, with each said pair of posts comprising a first and a second post each provided with first slots forming said first set of slots and second slots forming said second set of slots, said first posts of each said pair of posts being adjacent and attached to each other by said first brackets which engage said first slots in said first posts.

In one embodiment, said first end frame portion comprises slots, and wherein said first extremity of said brace rods are equipped with third brackets similar to said first brackets which engage said first end frame portion slots.

In one embodiment, said posts forming each said pair of posts of said intermediate frame portion are spaced-apart by means of crossbars which engage said second slots on each said post of said pair of posts.

In one embodiment, said second bracket engages the same slots as at least one crossbar which spaces-apart the first and second posts of at least one of said pairs of posts of said intermediate frame portion.

In one embodiment, said first shelves are supported between said first end frame portion and said intermediate frame portion by means of a number of lugs which each either co-operate with and engage said first set of slots in said intermediate frame portion or which are supported by said first end frame portion.

In one embodiment, said second spacer element comprises a number of struts extending between said second end frame portion and said intermediate frame portion, said struts each defining a first extremity attached to said second end frame portion and a second extremity opposite said first extremity and equipped with one said second bracket.

In one embodiment, each said second bracket is generally L-shaped and comprises an abutment plate abutting against said second frame portion and integrally attached to said strut, a linking plate attached to said abutment plate and at least one finger carried by said linking plate and co-operating with and engaging said second set of slots.

In one embodiment, each said strut is equipped at its first extremity with a fourth bracket similar to said second bracket, with said second end frame portion being provided with slots co-operating with and engaged by said fourth brackets to support said struts.

In one embodiment, each one of said second shelves is supported by a pair of spaced-apart, horizontally coplanar struts located and supported between said second end frame portion and said intermediate frame portion.

In one embodiment, each said pair of spaced-apart, side-by-side struts is linked by transverse reinforcement bars.

In one embodiment, said intermediate frame portion comprises a number of parallel posts each defining a polygonal cross-section and each consequently defining a number of longitudinal surfaces, each said post having first slots forming said first set of slots and second slots forming said second set of slots, with said first and second slots being provided on respective longitudinal surfaces.

In one embodiment, said second spacer element is a wall member having a first edge attached to said second end frame portion and a second edge opposite said first edge and equipped with at least one said second bracket.

In one embodiment, said intermediate frame portion comprises a number of parallel posts each defining a polygonal cross-section and each consequently defining a number of longitudinal surfaces, each said post having first slots forming said first set of slots and second slots forming said second set of slots, with said first and second slots being provided on respective longitudinal surfaces, at least two said posts being linked by means of at least one crossbar having at least one finger co-operating with and engaging a said second slot, said at least one finger of one of said struts co-operating with and engaging said second slot which is engaged by said at least one finger of said crossbar.

The invention also relates to a shelf assembly comprising:

a first end frame portion comprising two pairs of posts each defining first and second spaced-apart posts integrally linked by means of crossbars;

a second end frame portion spaced from said first end frame portion, said second end frame portion comprising a pair of spaced-apart posts linked by crossbars;

an intermediate frame portion located spacedly between said first and second end frame portions and comprising two pairs posts each defining first and second spaced-apart posts integrally linked by means of crossbars;

first and second sets of slots provided on said posts forming said first, second and intermediate frame portions, each said post having a polygonal cross-section and consequently defining a number of longitudinal surfaces, with said first and second set of slots being provided on respective longitudinal surfaces of said posts;

a first spacer element having a first extremity equipped with first bracket means that co-operate with and engage said first set of slots of said first posts of said first end frame portion thus integrally and releasably linking said two pairs of posts of said first end frame portion, and a second extremity equipped with second bracket means that co-operate with and engaged said first set of slots of said first posts of said intermediate frame portion thus integrally and releasably linking said two pairs of posts of said intermediate frame portion, said first end frame portion and said intermediate frame portion being integrally and releasably linked by said first spacer element;

a number of spacer struts having a first extremity equipped with third bracket means that co-operate with and engage said second set of slots of said posts of said second end frame portion, and a second extremity equipped with fourth bracket means that co-operate with and engage said second set of slots of said second posts of said intermediate frame portion, said second end frame portion and said intermediate frame portion being integrally and releasably linked by said second spacer struts;

first shelves located and supported between said first end frame portion and said intermediate frame portion; and second shelves located and supported between said second end frame portion and said intermediate frame portion.

The invention further relates to a strut for a shelving unit comprising an elongated main body defining first and second opposite ends, a bracket at each said first and second ends comprising an abutment plate integrally attached to said main body, a linking plate angularly integrally attached to said abutment plate and fingers integrally attached to said linking plate and protruding therefrom, said fingers being destined to engage slots provided on a polygonal post in the shelving unit with the slots of the shelving unit being provided on a first surface of the post, and with the abutment plate being destined to abut against a second surface of the polygonal post.

DETAILED DESCRIPTION OF THE EMBODIMENTS

Figure 1:
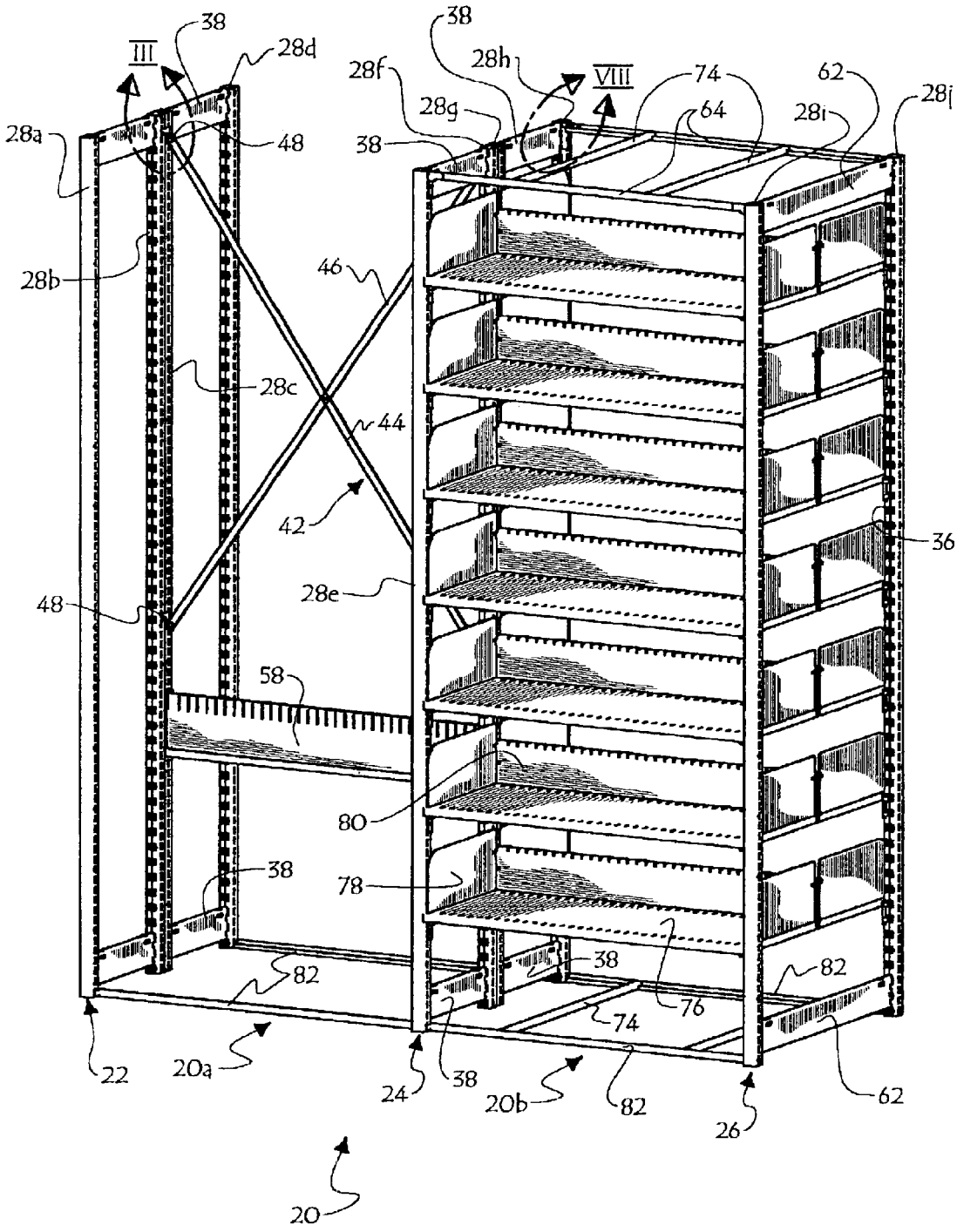
FIG. 1 is a top front perspective view of the hybrid shelving unit according to a first embodiment of the present invention, with the first shelf assembly portion of the shelving unit being devoid of shelves and equipped with a single shelf separator.
Figure 2:
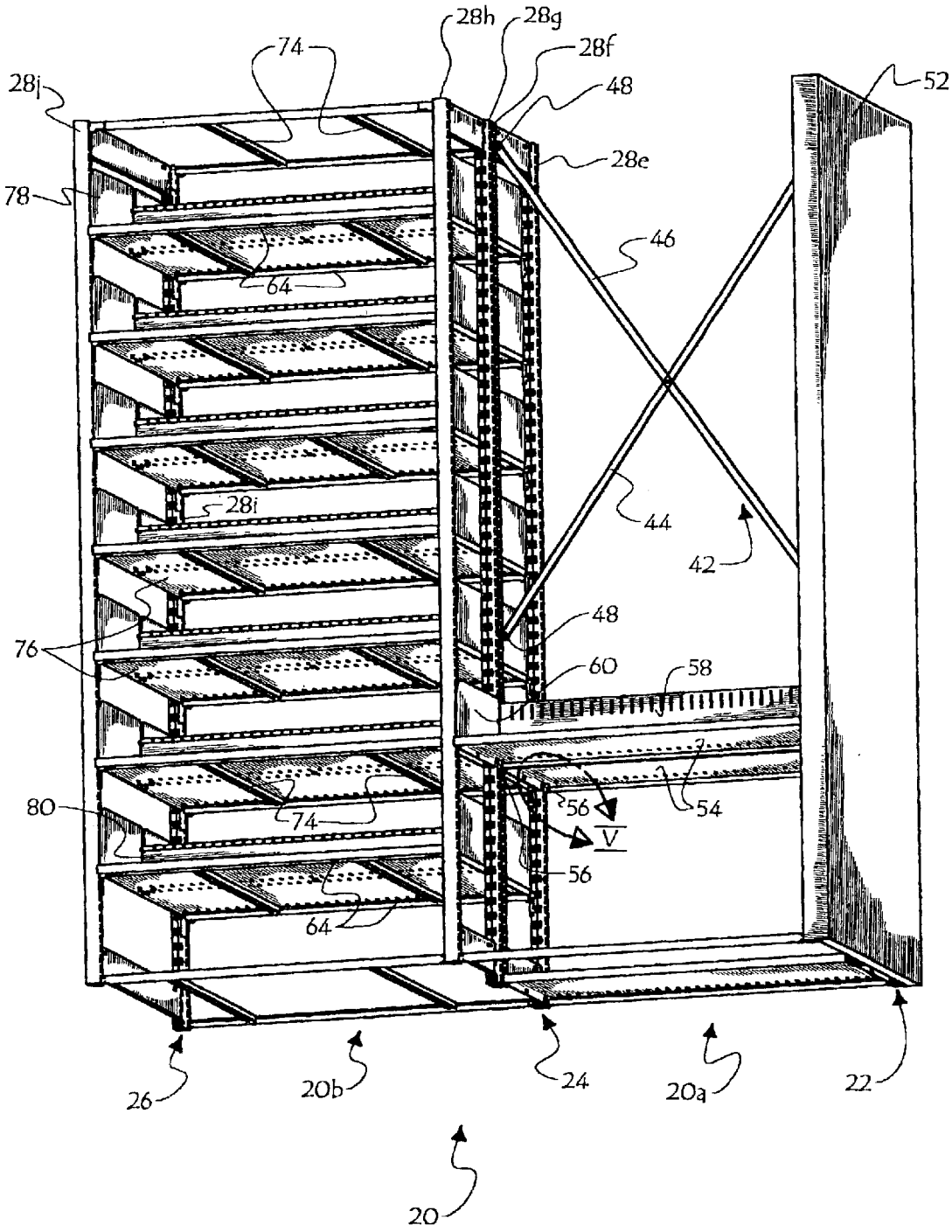
FIG. 2 is a bottom rear perspective view of the hybrid shelving unit of FIG. 1, with the first shelf assembly portion being provided with a single pair of side-by-side shelves and a shelf separator, and with a side panel being provided along the first end frame portion of the shelving unit.

FIGS. 1 and 2 show a shelving unit or shelf assembly 20 according to the present invention, which comprises two shelf assembly portions 20*a*, 20*b*. Shelving unit 20 comprises three spaced-apart upright frame portions, namely a first end frame portion 22, an intermediate frame portion 24 and a second end frame portion 26, frame portions 22, 24, 26 being linked to each other in a manner described hereinafter. The first shelf assembly portion 20*a* is defined between first end frame portion 22 and intermediate frame portion 24, and the second shelf assembly portion 20*b* is defined between second end frame portion 26 and intermediate frame portion 24. Shelf assembly portions 20*a*, 20*b* commonly share the intermediate frame portion 24.

Figure 3:
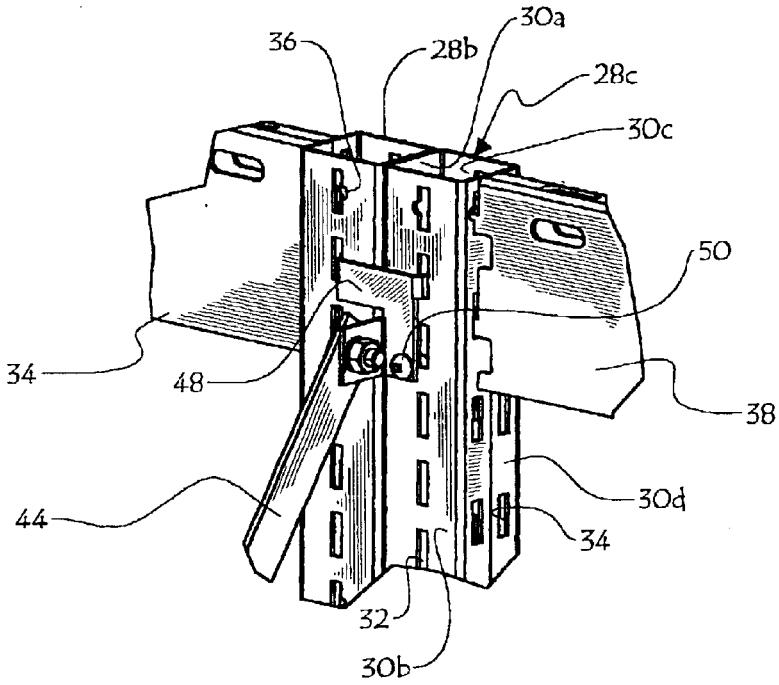
FIG. 3 is an enlarged perspective view of area III of FIG. 1.

Frame portions 22, 24, 26 are each formed with posts generally referred to by numeral 28. More particularly, first end frame portion 22 is formed of four posts 28*a*, 28*b*, 28*c*, 28*d*, intermediate frame portion is formed of four posts 28*e*, 28*f*, 28*g*, 28*h*, and second end frame portion is formed of two posts 28*i*, 28*j*. All posts 28, for example post 28*c* shown in FIG. 3, are of a same design, namely they are of rectangular cross-section and thus define four longitudinal surfaces generally referred to by numeral 30: a first surface 30*a* devoid of any slots; second and third surfaces 30*b* and 30*c* in facing register with each other and both provided with a similar first set of slots 32; and a fourth surface 30*d* in facing register with the first surface 30*a* and provided with a second set of slots 34. As shown, each one of the first and second set of slots 32, 34 comprises slots which are equally spaced along its corresponding surface 30, but which have a different spacing interval than that of the other set of slots 34, 32. More specifically, the first set of slots 32 comprises a single row of slots along each surface 30*b*, 30*c*, with the slots 32 being slightly larger than those of the second set of slots 34, the latter comprising two parallel rows of slots along surface 30*d*. The successive slots 32 are closer to each other than the successive slots 34. According to one embodiment, visual markers 36 in the form of a small indentations can be provided at regular intervals on the slots of the set of slots 32, 34 to facilitate visual reference when assembling the shelving unit 20.

Figure 4:
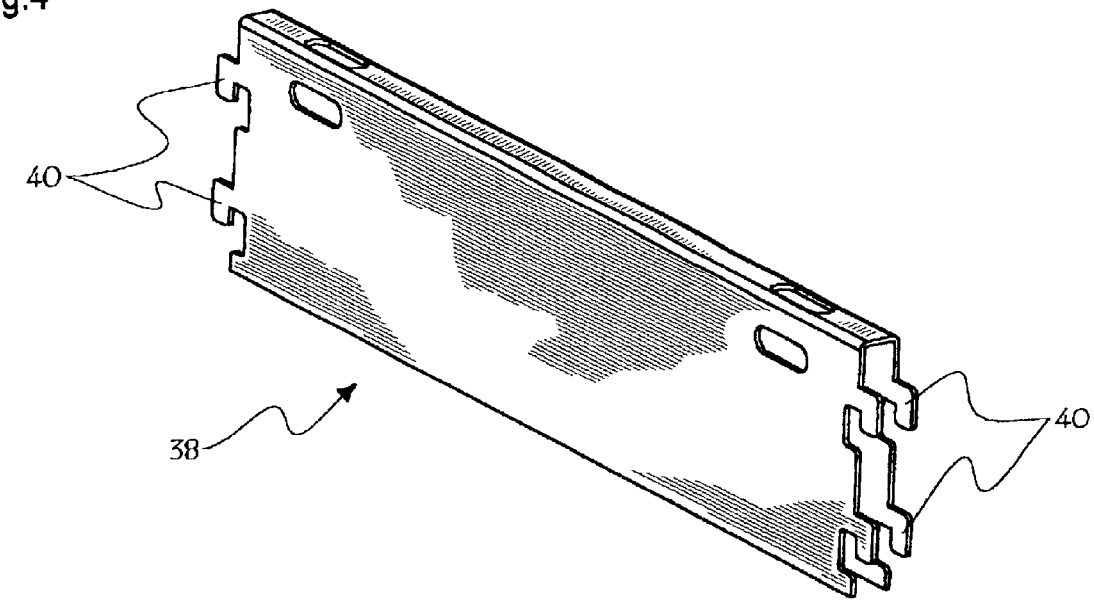
FIG. 4 is an enlarged perspective view of a crossbar forming the frame portions of the shelving unit of FIGS. 1 and 2.
Figure 9:
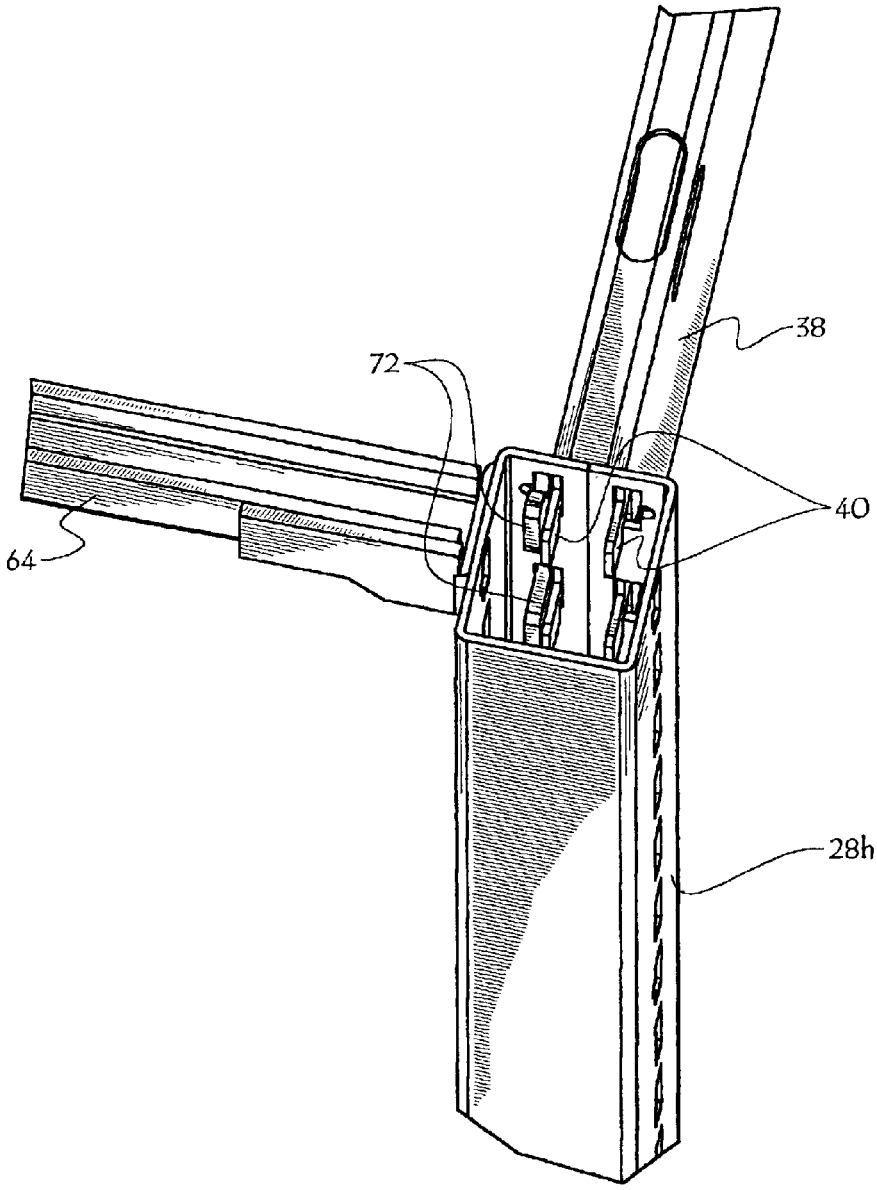
FIG. 9 is a perspective view similar to FIG. 8, but taken at a different angle to show more particularly the engagement of the strut bracket fingers and the crossbar fingers into the second set of slots of the frame post.

FIGS. 1 to 3 show that first end frame portion 22 and intermediate end frame portion 24 are both formed by assembling posts 28 by pairs, through the instrumentality of upper and lower crossbars 38 which, as further shown in FIG. 4, comprise fingers 40 sized and shaped to co-operate with and hookingly engage selected slots of the two rows of slots 34 of the fourth surfaces 30*d* of the two posts 28 of a pair of posts which are installed in facing register with each other (see also FIG. 9). First end frame portion 22 and intermediate frame portion 24 are furthermore spacedly assembled by means of a first spacer element in the form of a hinged brace 42 comprising two rods 44, 46 hinged at their central portion, with the two extremities of each rod 44, 46 being provided with three-fingered brackets 48 which engage slots of the first set of slots 32 of two side-by-side posts 28 which are part of different pairs of posts. Consequently, not only does brace 42 link first end frame portion 22 and intermediate frame portion 24, but also the brace brackets 48 link the two pairs of posts 28, 28 together in each frame portion 22, 24, as shown in FIG. 3. To facilitate the installation of brackets 48, they are pivotally installed at the extremities of rods 44, 46. Furthermore, to fixedly and releasably secure brackets 48 to posts 28, an optional bolt 50 extends through brackets 48 and a slot 32 of one post 28.

FIG. 2 shows that a side panel 52 can optionally be installed alongside first end frame portion 22. Side panel 52 is fixedly and releasably attached at the top and bottom ends of first end frame portion 22, for example by being bolted to crossbars 38.

Figure 5:
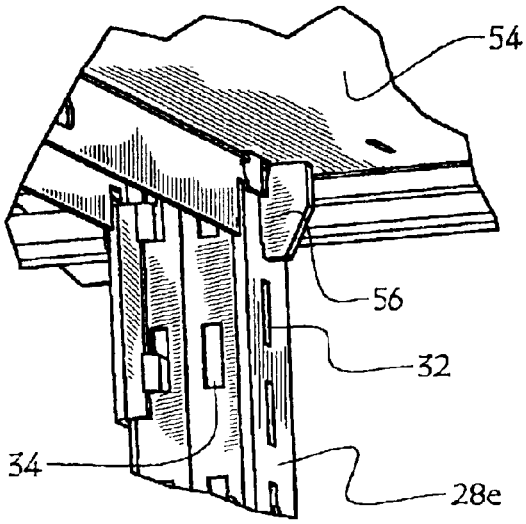
FIG. 5 is an enlarged perspective view of area V of FIG. 2.
Figure 6:
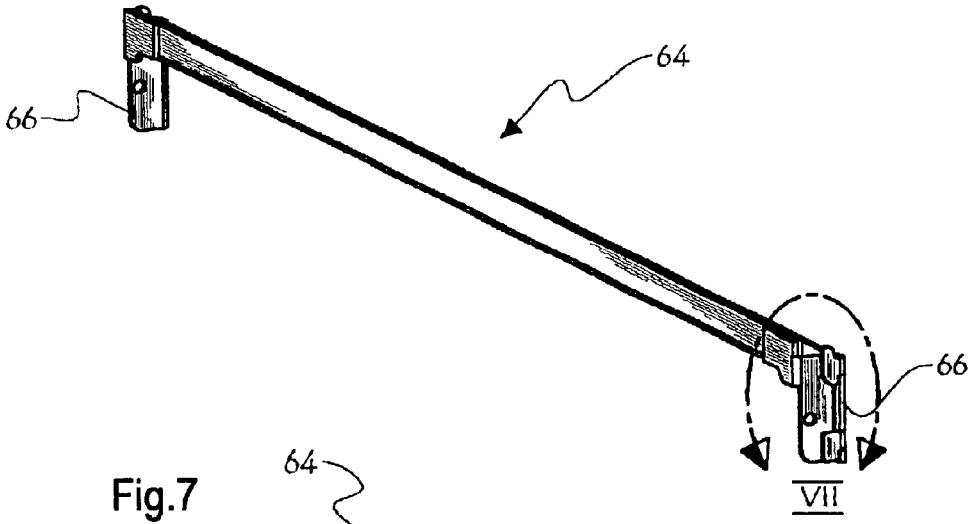
FIG. 6 is an enlarged perspective view of a strut of the shelving unit of FIGS. 1 and 2.
Figure 7:
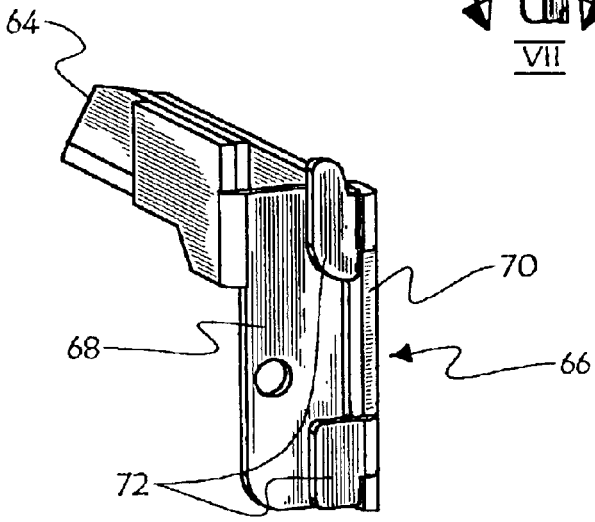
FIG. 7 is an enlarged perspective view of area VII of FIG. 6.

First shelves 54 are located and supported between first end frame portion 22 and intermediate frame portion 24. More specifically, as shown in FIGS. 2 and 5, first shelves 54 are supported by means of lugs 56 which each engage one of the slots of the first set of slots 32. In the embodiment shown in the drawings, two elongated shelves 54 are installed side-by-side in a same horizontal plane, with each shelf 54 occupying half the depth of shelving unit 20. A vertically extending separator panel 58, equipped with fingers (not shown) at its extremities that co-operate with and hookingly engage slots of the first set of slots 32, can also optionally be installed between shelves 54. Shelves 54 can include integral side panels 60, as shown.

Although only two shelves 54 are shown in the drawings, it is understood that any suitable number of vertically spaced-apart first shelves 54 could be provided in the first shelf assembly portion 20*a*. Also, a single first shelf occupying the full depth of shelving unit 20 could replace the pair of shelves 54.

As shown in FIGS. 1 and 2, second end frame portion 26 comprises a single pair of posts 28, linked by means of upper and lower crossbars 62 which are similar to crossbars 38 but which are longer. Crossbars 62 are also equipped with fingers at their extremities which co-operate with and engage the slots of the second set of slots 34 of posts 28*i*, 28*j*.

Figure 8:
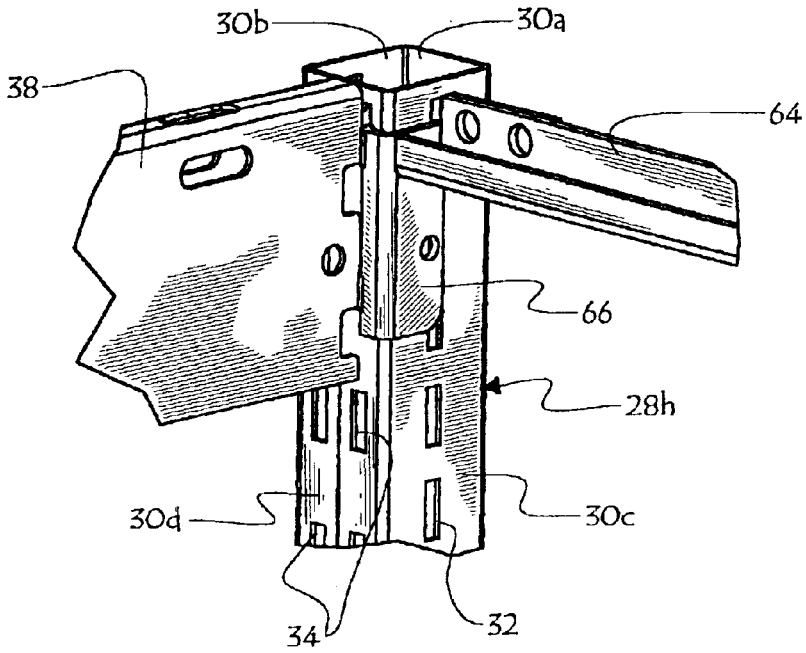
FIG. 8 is an enlarged perspective view of area VIII of FIG. 1.

As shown in FIGS. 1, 2, 6 and 7, a second spacer element in the form of a number of struts 64 is installed between the second end frame portion 26 and intermediate frame portion 24. Each strut 64 is provided at both its extremities with a strut bracket 66 which comprises an abutment plate 68 that is perpendicular to the longitudinal axis of the elongated strut 64, a linking plate 70 perpendicular to abutment plate 68, and a pair of fingers 72 perpendicular to linking plate 70. Each strut 64 can be releasably attached to frame portions 24, 26, for example to frame post 28*h* of intermediate frame portion 24 as further shown in FIGS. 8 and 9, by inserting the fingers 72 into the slots of the second set of slots 34 of post 28*h*. More particularly, the abutment plate 68 of strut bracket 66 abuts against the surface 30*c* of post 28*h* which is in facing register with second end frame portion 26, and the elbow formed by abutment plate 68 and linking plate 70 allows fingers 72 to engage two slots of the second set of slots 34 which is located on the side surface 30*d* of post 28*h*. Thus, two same slots of the second set of slots 34 are engaged both by fingers 40 of crossbar 38 and by fingers 72 of strut bracket 66 (FIG. 9).

Optional reinforcement bars 74 may be transversely installed between and fixed to two spaced-apart, horizontally coplanar struts 64.

Second shelves 76 are located and supported between second end frame portion 26 and intermediate frame portion 24. More particularly, second shelves 76 are each supported by a pair of horizontally coplanar struts 64 (FIG. 2), and also by the reinforcement bars 74. Second shelves 76 extend for the full depth of shelving unit 20, and may include integral side panels 78 and separator panels 80.

Four base frame bars 82 may also be fixedly attached in a known manner between frame portions 22, 24 and 24, 26. Reinforcement bars 74 may be installed between base frame bars 82.

Figure 11:
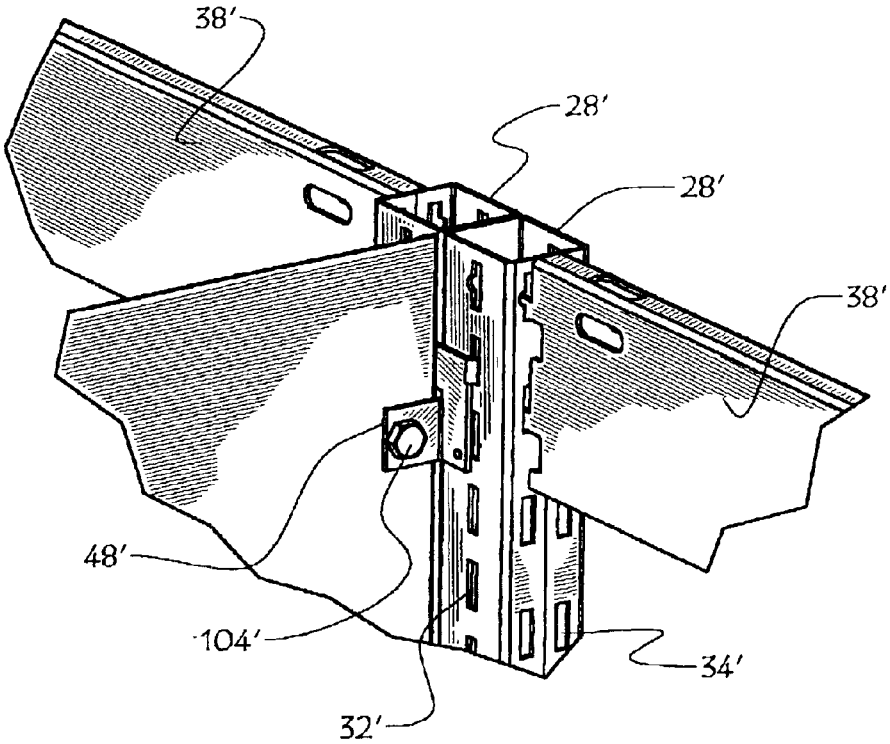
FIG. 11 is an enlarged perspective view of area XI of FIG. 10.
Figure 10:
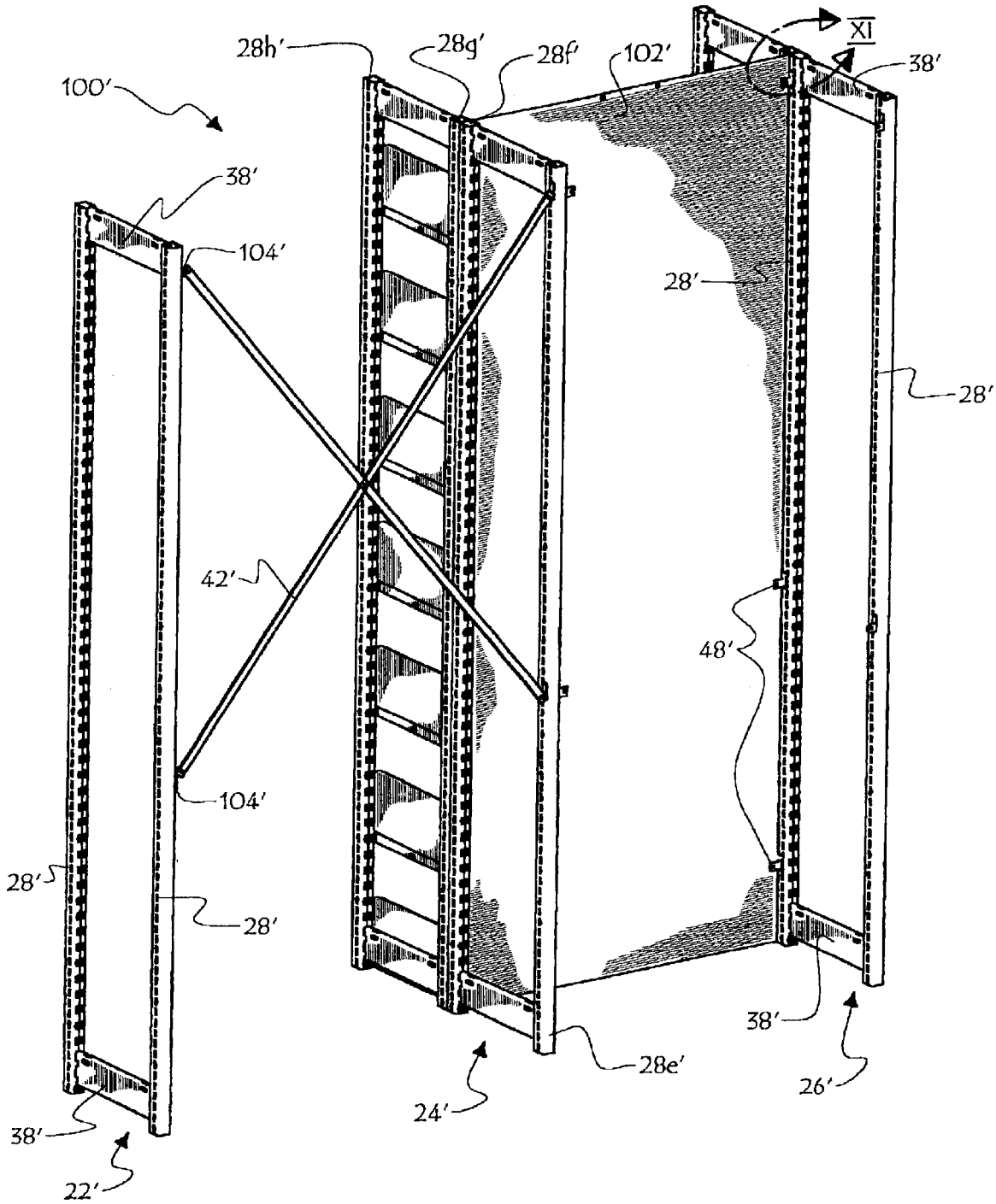
FIG. 10 is a perspective view of a second embodiment of a shelving unit of the invention.

FIG. 10 shows a second embodiment of a shelving unit 100' according to the present invention, in which all numerals are primed to differentiate them from those of the first embodiment. Similar elements in the second embodiment have a same numeral, although primed. Shelving unit 100' is similar to that of the first embodiment of the shelving unit 20, but comprises a different second spacer element in the form of a panel 102' instead of struts 64. Also, second end frame portion 26' comprises four posts 28' linked by pairs with crossbars 38'. As shown in FIGS. 10 and 11, panel 102' is attached to intermediate frame portion 24' and to second end frame portion 26' by means of brackets 48' which also have the purpose of linking the pairs of posts by engaging slots of the first sets of slots 32' of two adjacent posts 28' which are part of respective adjacent pairs of posts.

Also, the second embodiment of the shelving unit 102' comprises a first end frame portion 22' having a single pair of posts 28' which are linked by crossbars 38', although it is understood that two pairs of posts 28' could also be provided. The brace 42' is provided on a post 28*e*' of intermediate frame portion 24' which is not centrally located. Indeed, the brackets 48' of panel 102' already link the pairs of posts 28' of intermediate frame portion 24', and consequently brace 42' can be installed on any post 28' of intermediate frame portion 24'. Brackets 104' having a single or a pair of fingers are used to releasably attach brace 42' to first end frame portion 22' and to intermediate end frame portion 24'.

We claim:

1. A hybrid shelving unit comprising:

first and second spaced-apart end frame portions;

an intermediate frame portion located spacedly between said first and second end frame portions;

a first spacer element attached to said first end frame portion and linking said first end frame portion and said intermediate frame portion;

a second spacer element different from said first spacer element, attached to said second end frame portion and linking said second end frame portion and said intermediate frame portion;

first attachment means, attaching said first spacer element to said intermediate frame portion and comprising a first set of slots provided on said intermediate frame portion and at least one first bracket co-operating with and engaging said first set of slots, each one of said at least one first bracket being attached to said first spacer element second attachment means different from said first attachment means and attaching said second spacer element to said intermediate frame portion, said second attachment means comprising a second set of slots provided on said intermediate frame portion and at least one second bracket co-operating with and engaging said second set of slots, said at least one second bracket being attached to said second spacer element; and first shelves located and supported between said first end frame portion and said intermediate frame portion, and second shelves located and supported between said second end frame portion and said intermediate frame portion;

wherein said first spacer element is a hinged brace comprising a pair of rods hinged at an intermediate portion thereof, each rod of said pair of rods having a first extremity attached to said first end frame portion and a second extremity equipped with a said first bracket.

2. A shelving unit as defined in claim 1, wherein said intermediate frame portion comprises four parallel posts integrally linked by pairs, with each said pair of posts comprising a first and a second post each provided with first slots forming said first set of slots and second slots forming said second set of slots, said first posts of each said pair of posts being adjacent and attached to each other by said first brackets which engage said first slots in said first posts.

3. A shelving unit as defined in claim 2, wherein said first end frame portion comprises slots, and wherein said first extremity of said brace rods are equipped with third brackets similar to said first brackets which engage said first end frame portion slots.

4. A shelving unit as defined in claim 2, wherein said posts forming each said pair of posts of said intermediate frame portion are spaced-apart by means of crossbars which engage said second slots on each said post of said pair of posts.

5. A shelving unit as defined in claim 4, wherein said second bracket engages the same slots as at least one crossbar which spaces-apart the first and second posts of at least one of said pairs of posts of said intermediate frame portion.

6. A shelving unit as defined in claim 1, wherein said first shelves are supported between said first end frame portion and said intermediate frame portion by means of a number of lugs which each either co-operate with and engage said first set of slots in said intermediate frame portion or which are supported by said first end frame portion.

7. A shelving unit as defined in claim 1, wherein said second spacer element comprises a number of struts extending between said second end frame portion and said intermediate frame portion, said struts each defining a first extremity attached to said second end frame portion and a second extremity opposite said first extremity and equipped with one said second bracket.

8. A shelving unit as defined in claim 7, wherein each said second bracket is generally L-shaped and comprises and abutment plate abutting against said second frame portion and integrally attached to said strut, a linking plate attached to said abutment plate and at least one finger carried by said linking plate and co-operating with and engaging said second set of slots.

9. A shelving unit as defined in claim 8, wherein each said strut is equipped at its first extremity with a fourth bracket similar to said second bracket, with said second end frame portion being provided with slots co-operating with and engaged by said fourth brackets to support said struts.

10. A shelving unit as defined in claim 8, wherein each one of said second shelves is supported by a pair of spaced-apart, horizontally coplanar struts located and supported between said second end frame portion and said intermediate frame portion.

11. A shelving unit as defined in claim 10, wherein each said pair of spaced-apart, side-by-side struts is linked by transverse reinforcement bars.

12. A shelving unit as defined in claim 1, wherein said intermediate frame portion comprises a number of parallel posts each defining a polygonal cross-section and each consequently defining a number of longitudinal surfaces, each said post having first slots forming said first set of slots and second slots forming said second set of slots, with said first and second slots being provided on respective longitudinal surfaces.

13. A shelving unit as defined in claim 1, wherein said second spacer element is a wall member having a first edge attached to said second end frame portion and a second edge opposite said first edge and equipped with at least one said second bracket.

14. A shelving unit as defined in claim 8, wherein said intermediate frame portion comprises a number of parallel posts each defining a polygonal cross-section and each consequently defining a number of longitudinal surfaces, each said post having first slots forming said first set of slots and second slots forming said second set of slots, with said first and second slots being provided on respective longitudinal surfaces, at least two said posts being linked by means of at least one crossbar having at least one finger co-operating with and engaging a said second slot, said at least one finger of one of said struts co-operating with and engaging said second slot which is engaged by said at least one finger of said crossbar.

15. A shelf assembly comprising:

a first end frame portion comprising two pairs of posts each defining first and second spaced-apart posts integrally linked by means of crossbars;

a second end frame portion spaced from said first end frame portion, said second end frame portion comprising a pair of spaced-apart posts linked by crossbars;

an intermediate frame portion located spacedly between said first and second end frame portions and comprising two pairs posts each defining first and second spaced-apart posts integrally linked by means of crossbars;

first and second sets of slots provided on said posts forming said first, second and intermediate frame portions, each said post having a polygonal cross-section and consequently defining a number of longitudinal surfaces, with said first and second set of slots being provided on respective longitudinal surfaces of said posts;

a first spacer element having a first extremity equipped with first bracket means that co-operate with and engage said first set of slots of said first posts of said first end frame portion thus integrally and releasably linking said two pairs of posts of said first end frame portion, and a second extremity equipped with second bracket means that co-operate with and engage said first set of slots of said first posts of said intermediate frame portion thus integrally and releasably linking said two pairs of posts of said intermediate frame portion, said first end frame portion and said intermediate frame portion being integrally and releasably linked by said first spacer element;

a number of spacer struts having a first extremity equipped with third bracket means that co-operate with and engage said second set of slots of said posts of said second end frame portion, and a second extremity equipped with fourth bracket means that co-operate with and engage said second set of slots of said second posts of said intermediate frame portion, said second end frame portion and said intermediate frame portion being integrally and releasably linked by said second spacer struts;

first shelves located and supported between said first end frame portion and said intermediate frame portion; and second shelves located and supported between said second end frame portion and said intermediate frame portion.

* * * * *